US005902013A

United States Patent [19]

Hong

[11] Patent Number: 5,902,013

[45] Date of Patent: May 11, 1999

[54] ADJUSTABLE BACKREST OF OFFICE CHAIR

[76] Inventor: Chin-Lin Hong, 3rd Floor, No. 176, Yong Hsin Street, North District, Taichung, Taiwan

[21] Appl. No.: 09/114,716

[22] Filed: Jul. 13, 1998

[51] Int. Cl.[6] ..... B60N 2/02; F16M 13/00

[52] U.S. Cl. ..... 297/383; 248/429

[58] Field of Search ..... 297/383, 353; 248/429

[56] References Cited

U.S. PATENT DOCUMENTS 1,361,178 12/1920 Pipp .
2,784,769 3/1957 Fisher .
4,102,549 7/1978 Morrison et al. .
4,763,952 8/1988 Gaudreau, Jr. .
5,516,197 5/1996 Condos .
5,599,066 2/1997 Chih .

FOREIGN PATENT DOCUMENTS 11707 10/1990 WIPO .

*Primary Examiner*—Milton Nelson, Jr.
*Attorney, Agent, or Firm*—Harrison & Egbert

[57] ABSTRACT

An office chair is composed of a backrest, a seat, a support leg for supporting the seat, a sliding device, a locating device, and a control device. The sliding device includes two frame members and two sliding members. The locating device includes two toothed plates, two rotary plates and two elastic rods. The control device includes a press plate, an elastic rod, and a control rod. The backrest of the office chair can be adjusted back and forth to give a constant support to the back of an office worker seated on the office chair.

7 Claims, 6 Drawing Sheets

ADJUSTABLE BACKREST OF OFFICE CHAIR

FIELD OF THE INVENTION

The present invention relates generally to an office chair, and more particularly to an adjustable backrest of the office chair.

BACKGROUND OF THE INVENTION

Conventional office chairs have a backrest which is generally fixed and cannot be adjusted in its position. The backrest of the office chairs is in fact seldom used by an office worker in view of the fact that the body of the office worker is often kept close to the desk or computer keyboard, thereby resulting in a backache to the office worker.

SUMMARY OF THE INVENTION

The primary objective of the present invention is therefore to provide an office chair with an adjustable backrest which can be so adjusted in its position as to give constant support to the back of an office worker who is seated on the office chair.

In keeping with the principle of the present invention, the foregoing objective of the present invention is attained by an office chair comprising a seat and a backrest, which are provided with a sliding device, a locating device and a control device. The backrest of the office chair can be thus adjusted back and forth to give a support to the back of an office worker seated on the office chair.

The foregoing objective, features and functions of the present invention will be more readily understood upon a thoughtful deliberation of the following detailed description of the present invention with reference to the accompanying drawings.

DETAILED DESCRIPTION OF THE INVENTION

Figure 1:
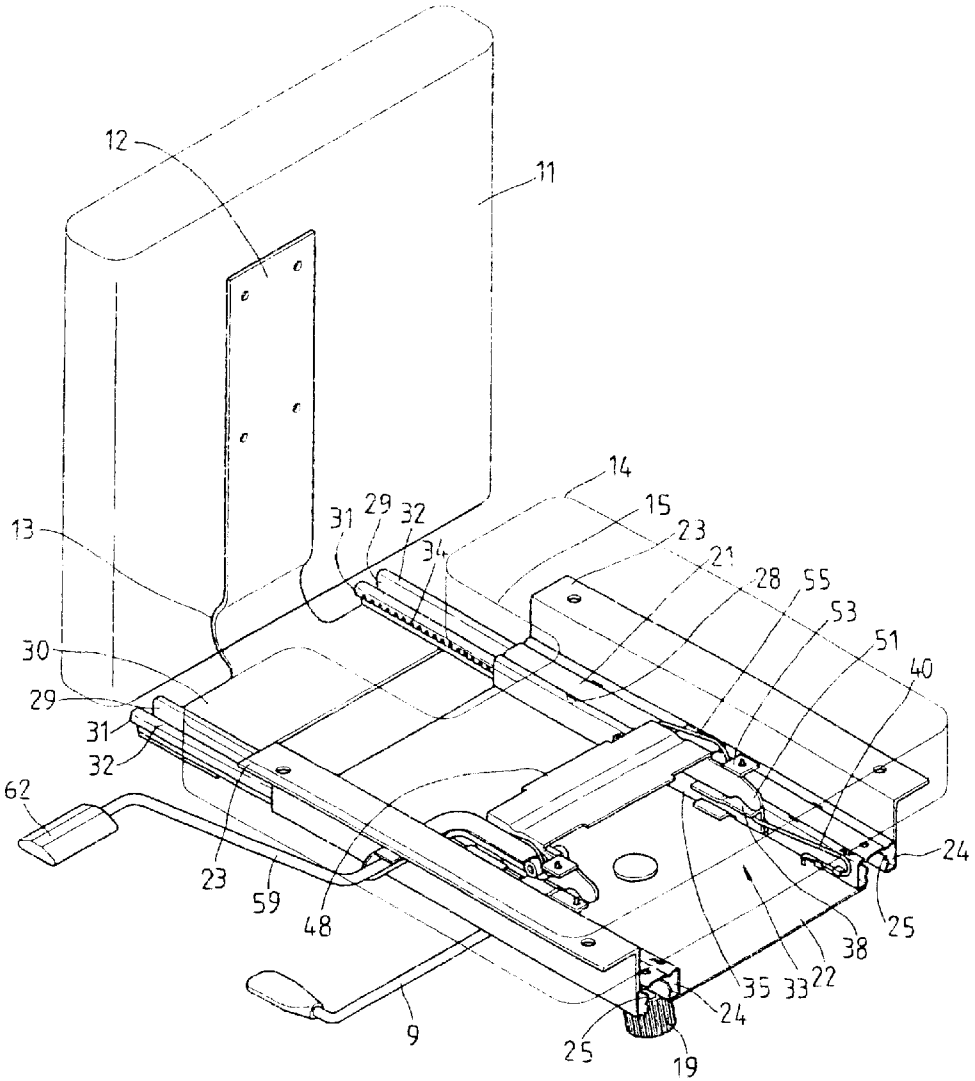
FIG. 1 shows a perspective view of the present invention.

As shown in all drawings provided herewith, a backrest adjusting assembly of an office chair of the present invention is composed of a sliding device 20, a locating device 33, and a control device 47. The office chair may be provided with only the sliding device 20, without the locating device 33 and the control device 47. In other words, the present invention can include the sliding device 20, with or without the locating device 33 and the control device 47. However, the locating device 33 and the control device 47 must be employed hand in hand.

The office chair embodied in the present invention is composed of a backrest 11 and a seat 14. The backrest 11 is supported by a backrest support plate 12 which has an elastic curved portion 13 extending to reach the underside of the seat 14. The sliding device 20 is mounted between the curved portion 13 of the backrest support plate 12 and the underside of the seat 14.

The sliding device 20 comprises two frame members 21 and two sliding members 29.

The two frame members 21 are similar in construction to each other and are mounted on a base plate 22 such that the two frame members 21 are opposite in location to each other and parallel to each other. The frame members 21 and the base plate 22 are mounted under the seat 14. The two frame members 21 have an inverted U-shaped cross section, a support plate 23, two guide slots 24 and two slide rails 25.

The two sliding members 29 are fastened respectively at one end thereof with an extension plate 30 such that they are parallel to each other. The two sliding members 29 are respectively provided with two shoulders 32 each having a holding plate 31. The two sliding members 29 are engaged with the two frame members 21 such that the shoulders 32 are supported on the slide rails 25 of the frame members 21, and that the holding plates 31 of the shoulders 32 are located in the guide slots 24.

The sliding device 20 enables the backrest 11 of the office chair to move back and forth as desired.

Figure 3:
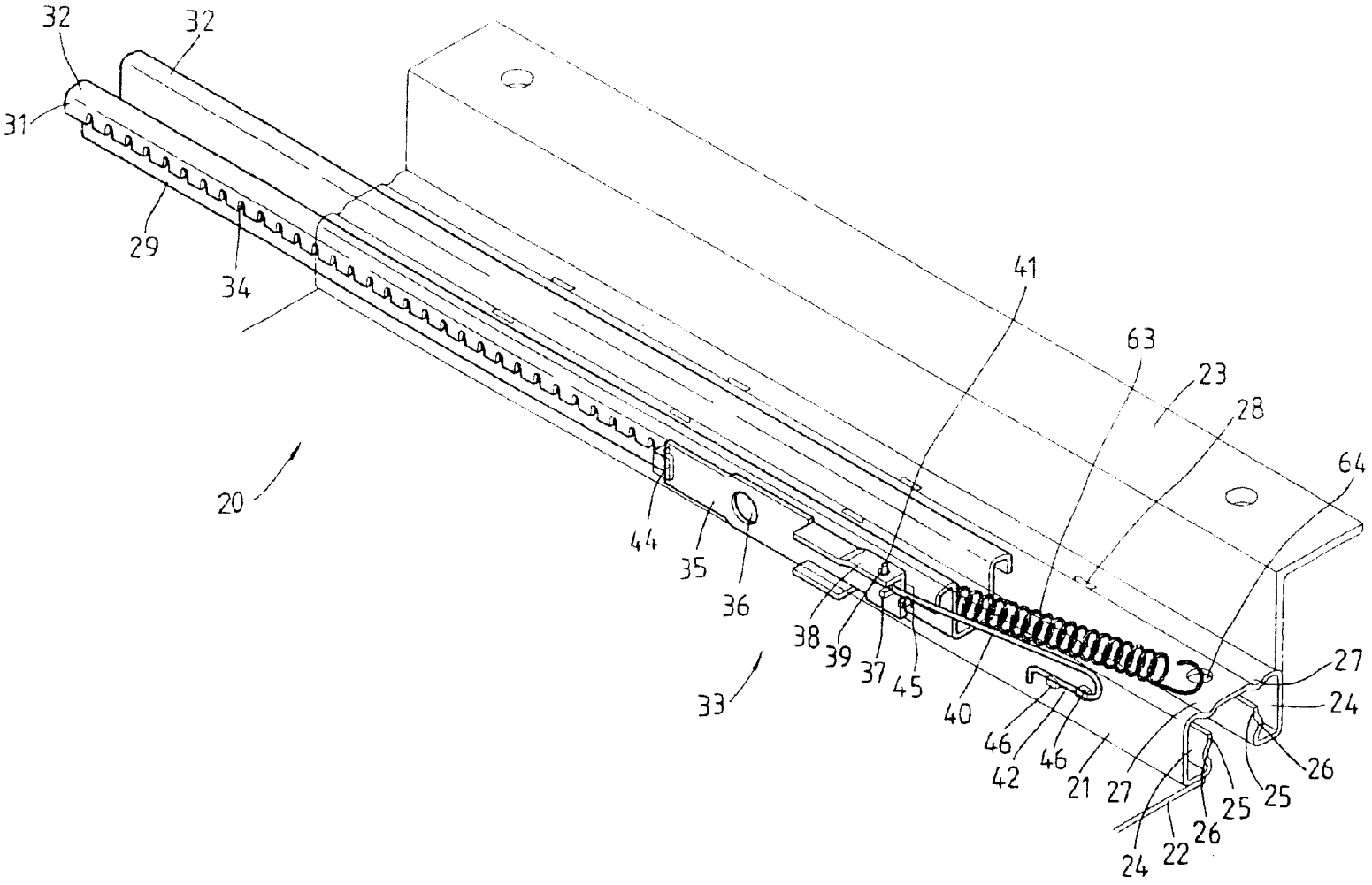
FIG. 3 shows a partial perspective view of the present invention in combination.
Figure 4:
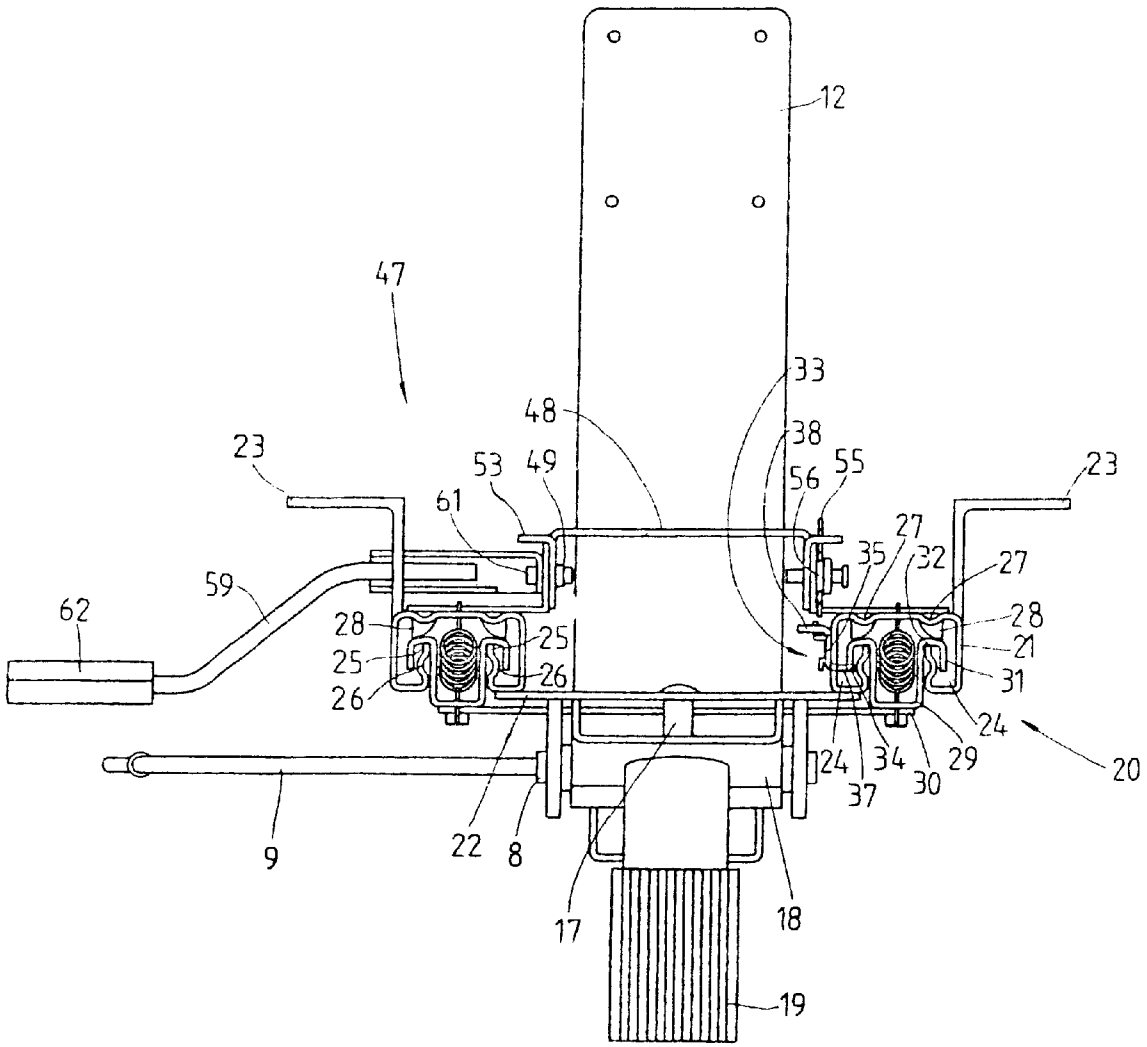
FIG. 4 shows a front view of the present invention.

As shown in FIGS. 3 and 4, the slide rails 25 of the frame members 21 are additionally provided with a ribbed edge 26 intended to reduce the contact area between the slide rails 25 and the sliding members 29. In addition, each slide rail 25 has a recessed edge 27 which is provided with a plurality of protrusions 28 for forcing the shoulder 32 of the sliding member 29 to locate on the slide rail 25.

Figure 2:
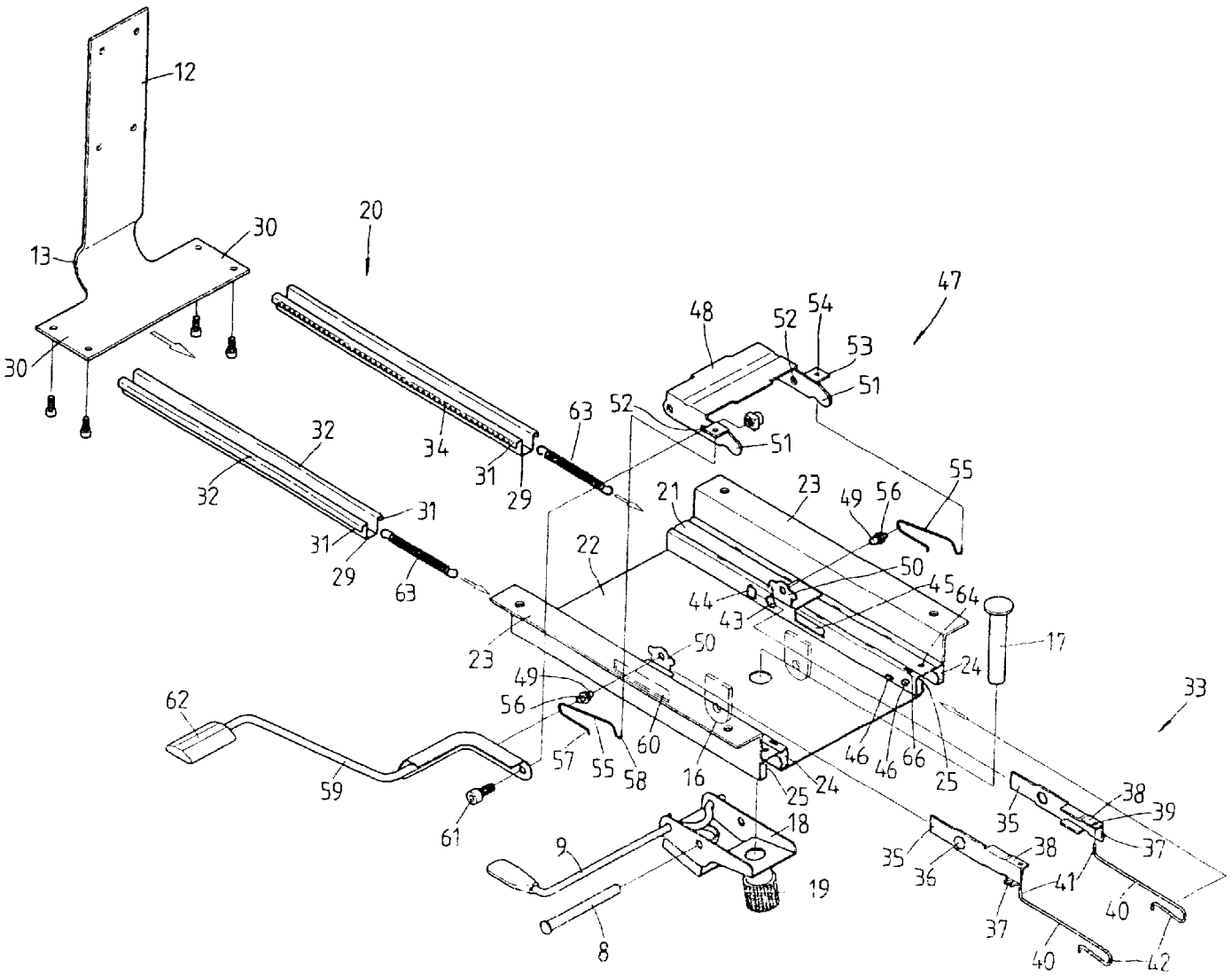
FIG. 2 shows an exploded view of the present invention.
Figure 5:
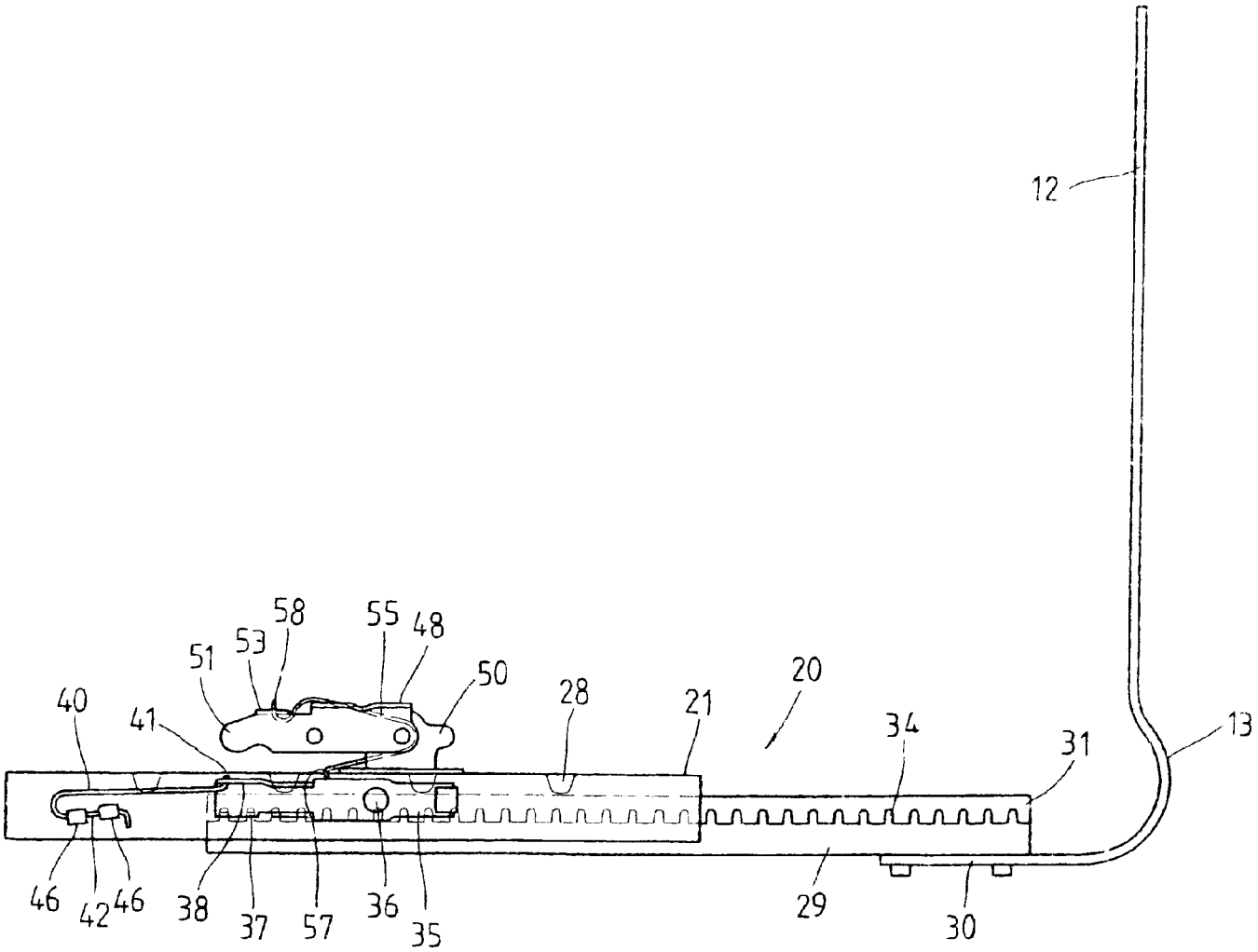
FIG. 5 shows a side view of the present invention.
Figure 6:
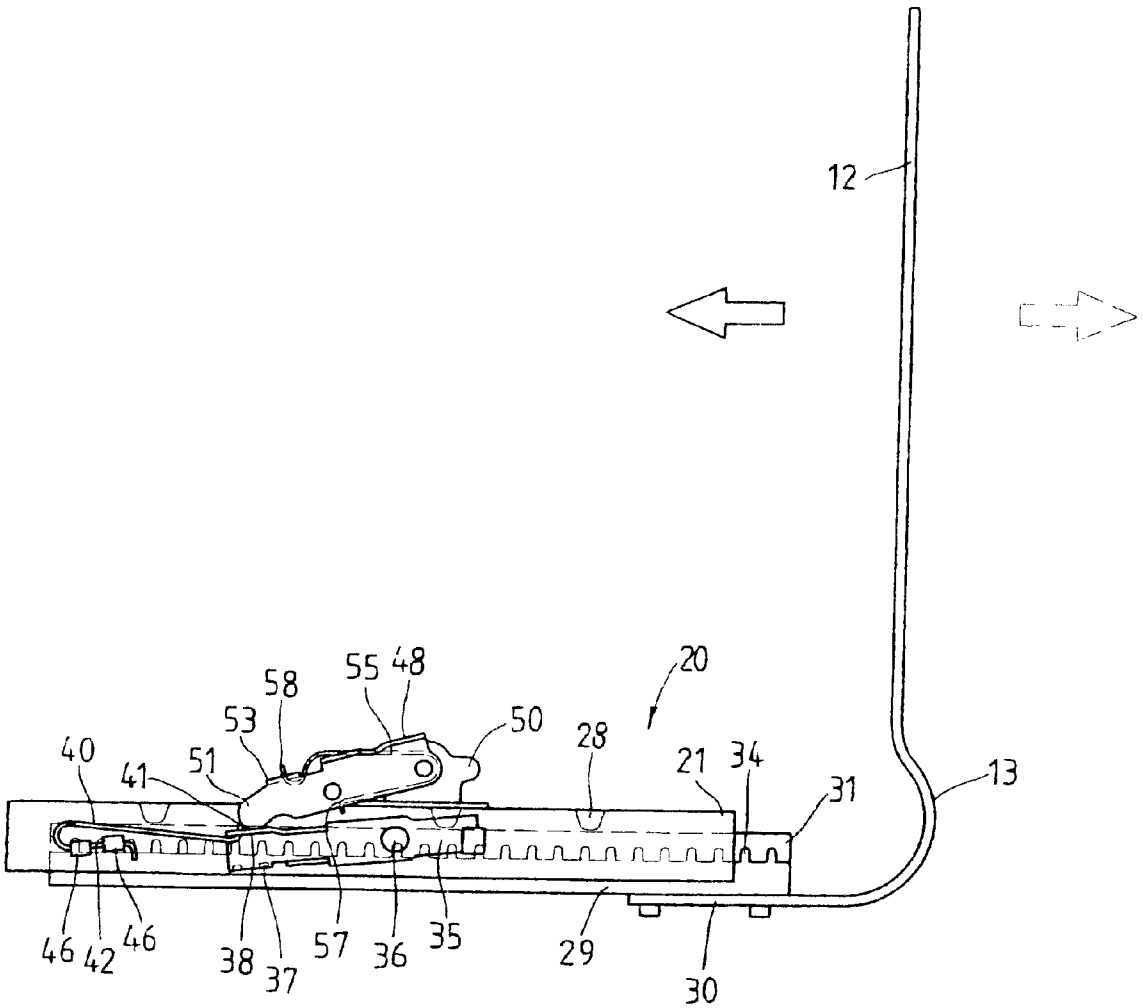
FIG. 6 shows a side view of the present invention in operation.

As shown in FIGS. 1, 2 and 5, the present invention further comprises the locating device 33 and the control device 47, which are provided hand in hand.

The locating device 33 has two toothed plates 34 which are formed with the holding plates 31 of the sliding members 29. The locating device 33 further has two rotary plates 35 and two elastic rods 40. The rotary plates 35 are provided respectively with a protuberance 36, a locating frame 37 corresponding in location to the toothed plate 34, and a sustaining plate 38 which is provided with a retaining hole 39. The elastic rods 40 are respectively provided with a retaining end 41 and a hooked end 42 opposite in location to the retaining end 41.

The two frame members 21 are provided with a fitting hole 43 and an insertion plate 44. The rotary plate 35 is fastened pivotally with the frame member 21 such that the locating frame 37 of the rotary plate 35 is received in the guide slot 24 via a through slot 45 of the frame member 21, and that the retaining end 41 of the elastic rod 40 is retained in the retaining hole 39 of the sustaining plate 38, and further that the locating frame 37 of the rotary plate 35 is engaged with the toothed plate 34.

The control device 47 is mounted on the sliding device 20 and is composed of a press plate 48, an elastic rod 55, and a control rod 59.

The press plate 48 is pivotally mounted on two lugs 50 of the two frame members 21 by means of two pivots 49. The press plate 48 has two press ends 51 extending in the same direction and having a retaining hole 52 and a protruded piece 53 which is provided with a locating hole 54.

The elastic rod 55 has a curved portion which is retained in a groove 56 of the pivot 49. The elastic rod 55 further has a hooked end 57 which is retained by an extension edge of the lug 50 of the press plate 48. The elastic rod 55 still further has a retaining end 58 which is retained in the locating hole 54.

The control rod 59 is put through a through slot 60 of the support plate 23 of the frame member 21 such that one end of the control rod 59 is fastened pivotally with the press plate 48 by a fastening bolt 61 which is engaged with a fastening hole of that one end of the control rod 59 and the retaining hole 52 of the press plate 48. The control rod 59 is intended to cause the press ends 51 of the press plate 48 to remain a distance away from the sustaining plate 38 of the rotary plate 35 of the locating device 33. In the meantime, the locating frame 37 of the rotary plate 35 is caused to swing downwardly so as to disengage the toothed plate 34.

As shown in FIG. 1, there are two resilient elements 63 which are respectively located between the frame member 21 and the sliding member 29 such that both ends of each of the two resilient elements 63 are retained in a retaining hole 64 of the frame member 21 and a retaining hole 65 of the sliding member 29, as shown in FIG. 3. The frame members 21 of the sliding device 20 are respectively provided at one end thereof with a stop edge 66 for confining the sliding member 29. As shown in FIG. 1, the seat 14 is provided with a yielding edge 66 defining a moving space which is intended to enable the backrest support plate 12 to move about at the time when the backrest 11 is adjusted back and forth. The moving space defined by the yielding edge 66 may be replaced by deepening the curvature of the curved portion 13 of the backrest support plate 12.

The support plate 23 of the sliding device 20 may be provided with a tug plate 16 fastened therewith for fastening pivotally the support plate 23 with a support seat 18 located at the top of the support leg of an office chair. The support seat 18 of the chair support leg is fastened pivotally with the lug plate 16 of the support plate 23 by a pivot 8. The support seat 18 is provided with an action rod 9 for adjusting the level of the seat 14.

I claim:

1. An office chair comprising a back rest, a seat, a support leg for supporting said seat, and a sliding device mounted between a curved portion of a backrest support plate of said backrest and an underside of said seat; wherein said sliding device comprises:

two frame members similar in construction to each other and mounted on a base plate such that said two frame members are parallel to each other, said two frame members having an inverted U-shaped cross section, a support plate, two guide slots, and two slide rails; and two sliding members fastened respectively at one end thereof with an extension plate such that said two sliding members are parallel to each other, said two sliding members provided respectively with two shoulders each having a holding plate, said two sliding members being engaged with said two frame members such that said shoulders are supported on said slide rails of said frame members, and that said holding plates of said shoulders are located in said guide slots.

2. The office chair as defined in claim 1, wherein said slide rails of said frame members are provided with a ribbed edge, said slide rails having a recessed edge which is provided with a plurality of protrusions for forcing said shoulders of said sliding member to locate on said slide rail.

3. The office chair as defined in claim 1, wherein said support plate is provided with a lug plate fastened therewith for fastening said support plate with a support seat of the support leg of the office chair, said support seat provided with an action rod fastened therewith for adjusting the level of said seat.

4. The office chair as defined in claim 1, wherein said sliding device is provided with two resilient elements located between said two frame members and said two sliding members such that one end of each of said two resilient elements is retained in a retaining hole of one of said frame members and another end of each of said two resilient members is retained in a retaining hole of one of said sliding members.

5. The office chair as defined in claim 1, wherein said frame members are respectively provided at one end thereof with a stop edge for confining said sliding members.

6. The office chair as defined in claim 1, wherein said seat is provided with a yielding edge defining a moving space.

7. An office chair comprising:

a backrest;

a seat;

a support leg supporting said seat;

a sliding device mounted between a curved portion of a backrest support plate of said backrest and an underside of said seat, said sliding device comprising:

two frame members similar in construction to each other, said two frame members being mounted on a base plate such that said two frame members are parallel to each other, said two frame members each having an inverted U-shaped cross section, a support plate, two guide slots and two slide rails; and two sliding members fastened respectively at one end thereof with an extension plate such that said two sliding members are parallel to each other, said two sliding members provided respectively with two shoulders each having a holding plate, said two sliding members being engaged with said two frame members respectively such that said shoulders are supported on said slide rails of said frame members, said holding plates of said shoulders being respectively located in said guide slots;

a locating device mounted between said frame members and said sliding members of said sliding device, said locating device comprising:

two toothed plates formed respectively with the holding plates of said sliding members of said sliding device;

two rotary plates provided respectively with a protuberance, a locating frame corresponding in location to said toothed plates, and a sustaining plate provided with a retaining hole; and an elastic rod provided respectively with a retaining end and a hooked end opposite in location to said retaining end, each of said rotary plates being fastened pivotally with a frame member of said sliding device such that said locating frame of a rotary plate is received in said guide slot of said frame member via a through slot of said frame member, said retaining end of said elastic rod is retained in said retaining hole of said sustaining plate, said locating frame of said rotary plate is engaged with said toothed plate of said locating device; and a control device mounted on said sliding device, said control device comprising:

a press plate mounted pivotally by two pivots respectively on two lugs of said two frame members of said sliding device, said press plate provided with two press ends extending in a same direction, each of said press ends having a retaining hole and a protruded piece, said protruded piece being provided with a locating hole;

an elastic rod having a curved portion which is retained in a groove of one of said two pivots of said press plate, said elastic rod having a hooked end which is retained by an extension edge of said lugs of said press plate, said elastic rod having a retaining end which is retained in said locating hole of said protruded piece of said press ends of said press plate; and a control rod extending through a through slot of said support plate of said frame member of said sliding device such that one end of said control rod is fastened pivotally with said press plate by a fastening bolt which is engaged with a fastening hole at said one end of said control rod and with said retaining hole of said press plate, said control rod causing said press ends of said press plate to remain a distance away from said sustaining plate of said rotary plate of said locating device.

* * * * *